United States Patent [19]

Katterbach et al.

[11] Patent Number: 4,584,747

[45] Date of Patent: Apr. 29, 1986

[54] IRONING/MANGLE ROLLER

[75] Inventors: Helmüt Katterbach, Bergweg 7, 5202 Hennef 1-Berg; Klaüs Schröter, Worms; Johannes Daniel, Dormagen, all of Fed. Rep. of Germany

[73] Assignee: Helmut Katterbach, Fed. Rep. of Germany

[21] Appl. No.: 773,247

[22] Filed: Sep. 6, 1985

[30] Foreign Application Priority Data

Sep. 14, 1984 [DE] Fed. Rep. of Germany ..... 3433780

[51] Int. Cl.[4] ..... B30B 3/00; B30B 3/02

[52] U.S. Cl. ..... 29/121.5; 29/132; 38/53

[58] Field of Search ..... 29/121.5, 121.2, 121.3, 29/121.1, 132, 110; 38/53, 66

[56] References Cited

U.S. PATENT DOCUMENTS 1,668,614 5/1928 Taylor ..... 29/124

1,833,461 11/1931 Grupe ..... 29/121.1

2,497,696 2/1950 Smith ..... 29/121.1

*Primary Examiner*—Howard N. Goldberg

*Assistant Examiner*—Irene Golabi

*Attorney, Agent, or Firm*—Diller, Ramik & Wight

[57] ABSTRACT

An ironing roller adapted for use in a heated trough mangle comprising a hollow cylindrical drum having a plurality of perforations therethrough thereby forming a generally screen-type perforated shell, a gas permeable padding layer formed of intrinsic elastic material, the padding layer being defined by a plurality of strips of material connected together in end-to-end and wrapped helically about the shell, the elastic material being thermally resistant resiliant silicon rubber having a Shore hardness generally within the range of 50 to 75, but preferably 55 to 65, a mesh-like inlay within the strips, a fabric cover covering an exterior generally cylindrical surface of the padding layer, the exterior cylindrical surface being roughened, the strips having a plurality of through holes distributed along the lengths thereof, the strips having under surfaces engaging the perforated shell with a plurality of channel-like grooves therein interconnecting the through holes, the strips having stepped ends each defining a tongue, the tongues being in overlapped relationship to each other, and fasteners for securing the tongues together.

19 Claims, 4 Drawing Figures

IRONING/MANGLE ROLLER

The novel invention set forth herein relates to an ironing roller particularly adapted for use in laundries in which the ironing roller rotates in a heated trough mangle.

The ironing roller or mangle roller of this invention is formed as a hollow, rigid, metallic (preferably steel) drum having a plurality of perforations thereabout to form a screen-type perforated shell.

A gas-permeable padding layer of intrinsic elasticity covers the perforated shell, and the padding layer is covered by a fabric cover, e.g., molleton cotton, needle felt, etc.

Conventional ironing rollers or mangle rollers employ different configurations of intrinsic resilient padding layers to impart a certain degree of flexibility to the exterior working surface of the rollers. Bands or strips of metal have been used which, due to their design, have been rendered flexible in the radial direction. Normally, such metal bands or strips are secured to the conventional drum shell by being helically wound thereupon.

There is also conventional so-called lamellar spring bands which are formed by positioning lamellar sheets obliquely between outer and inner metal bands to obtain a radially compressible lamellar spring band.

Another conventional padding layer contains a metallic strip supporting helical wire spring structures arranged in series. The compressibility is ensured by the adjacent helically wound wire springs.

Furthermore, use has been made of springs of steel wool which are also wrapped about the drum shell of another conventional mangle roller. Windings of lamellar spring bands and also helical spring bands about the roll drum periphery is, of course, expensive. In the case of metal spring bands, particularly lamellar spring bands, there is a certain degree of rigidity that must be overcome to ensure that the metal spring bands intimately engage the perforated drum shell over a considerable number of windings. Steel wool bands do not generally afford difficulties in the latter respect, but the spring action of a padding layer formed by a steel wood band is not as high as that of a lamellar spring band or of a helical spring band.

Ironing and mangling is, of course, performed under elevated temperatures from a suitable source of heat, most often steam. The higher the temperature in the padding layer of the mangle/ironing roller, within a predetermined range, the better the ironing affect. The steam formed during the mangling/ironing of wet cloth (linen, for example) is removed by air current being drawn through the padding and into the drum shell through appropriate openings or perforations in the latter by means of an exhaust fan or the like. The latter is, of course, necessarily accompanied by a certain undesired cooling affect. Common to all metal padding layers is the fact that the supplied heat is retained therein, but this is rather poor retention because metal has a rather high thermal conductivity. Thus, energy consumption is relatively high if the ironing rollers are kept at the necessary high temperature for effective ironing/mangling operation operations.

It is a primary object of the present invention to provide a novel ironing a mangle roller which includes a padding layer of good elasticity and relatively high heat capacity which can be easily applied to a perforated steel shell. The invention is characterized by forming the padding layer of a thermally resistant flexible silicon rubber having a Shore hardness within the range of 30 to 75, but preferably between 55 or 65 with 60 being the optimum, and at least one net or mesh inlay interiorly of the padding layer.

A padding layer as just described offers a number of advantages during the operation of a steam heated ironing or mangle roller. As compared to known flexible metallic strips forming the conventional padding layer, the winding of the silicon rubber strip or band substantially facilitates the winding operation and, thus, the manufacture of the ironing/mangle roller. It is relatively easy to apply the silicon rubber strip under tension an exterior surface of the perforated drum shell of the ironing roller. Preferably the strip is applied to the drum shell under tension and, thus, it is in intimate engagement therewith, even when heated. There is little, if any, subsequent displacement or mutual shifting between the strip(s) and the perforated drum shell and the construction is such as to virtually assure that the strip will never inadvertently or accidentally unwind from the drum shell.

In the case of ironing or mangle rollers of a small diameter, the silicon rubber strip is capable of being wound to the sharper curvature of smaller diameter rollers than conventional resilient metallic strips heretofore noted. Furthermore, it is far simpler to handle silicon strips and this, in turn, saves time and money. Finally, since silicon rubber is not as heat conductive as metal, the overall heat loss is less, the efficiency is thereby increased, and, as compared to metal, the elasticity of the silicon rubber strips outlast that of the metallic strips. Also, if the metal bands are accidentally deformed or local impressions are formed therein by hard elements carried by or in the pockets being ironed, such deformations or impressions may not rebound or might not do so for a considerable length of time. Thus, the overall exterior ironing surface of the padding layer is distorted and ironing will not be uniform. However, the latter disadvantage is totally eliminated by the silicon padding layer of the present invention since the elasticity thereof is such as to cause virtually immediate rebound of any local impressions caused by hard elements during an ironing/mangling operation. Hence, uniformily fine ironing quality is maintained while, at the same time, heat transfer permits such to be accomplished in an economical fashion.

In keeping with another object of this invention, the padding strip(s) of the elastic silicon rubber is provided with a pluralty of holes therethrough and along the length thereof, such as to construct the padding strip as a screen. Furthermore, an exterior surface of the padding strip is roughened, as by corrugations, such that a cloth cover positioned thereupon will not slip therefrom or therealong. Furthermore, due to the holes in the silicon rubber strip(s), a quick and perfect escape is provided for the steam and holes also are so arranged in number and distribution as to ensure proper resilience/-hardness of the padding layer.

In keeping with a further object of this invention, the underside of each padding strip is also provided with channel-like grooves which interconnect with the through holes of the strip(s) to ensure that as suction is drawn in the interior of the associated shell, the steam-/air is drawn in a quick and safe manner. Further, condensation can not be formed at the padding layer which is kept dry and, thus, highly effective.

Preferably, the individual narrow strips which form the padding layer have ends which are stepped or offset to define tongues. The latter tongues are overlapped and screwed or riveted together. Thus, in this fashion several strips can be wound in a helical fashion about the shell to form the padding layer.

In further accordance with this invention, in order to avoid the individual strips and, thus, the overall padding layer from tearing, the individual strips have cured therein a sheet of stainless steel material provided with barbs or in the form of a screen or mesh. The latter contribute to a safe and reliable connection between the tongues of adjacent strips, with, of course, the screws or rivets passing not only through the silicon rubber of the tongues, but also through the stainless steel sheets, mesh-like or net-like material.

With the above and other objects in view that will hereinafter appear, the nature of the invention will be more clearly understood by reference to the following detailed description, the appended claims and the several views illustrated in the accompanying drawings.

Figure 1:
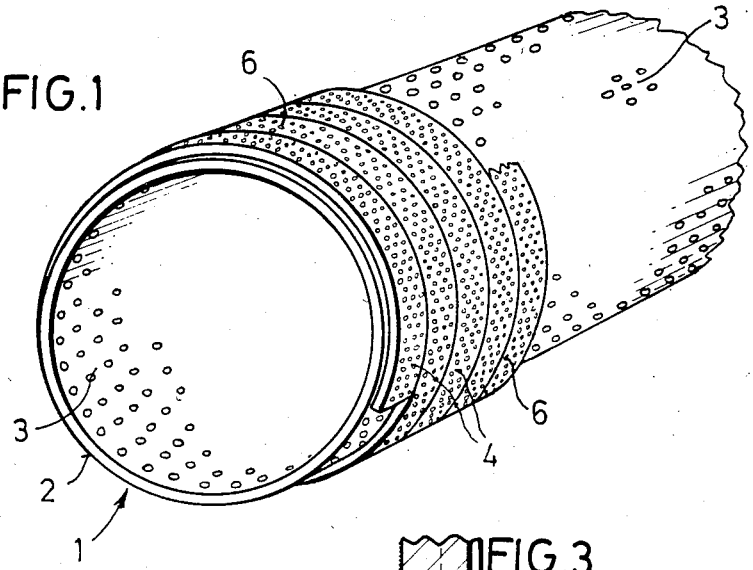
FIG. 1 is a fragmentary perspective view of an ironing roller or mangle roller of this invention, and illustrates a gas permeable padding layer formed of a strip(s) of perforated silicon rubber helically wound about a screen-type perforated shell.

A novel ironing or mangle roller of this invention is generally designated by the reference numeral 1 and includes a hollow, cylindrical, metallic (steel) drum shell 2 provided with a plurality of perforations 3 distributed thereover, thus transforming the shell 2 into a screen-like cylinder.

A resilient padding layer (unnumbered) is applied to an outer peripheral surface (also unnumbered) of the drum shell 2. The resilient padding layer is formed by a strip(s) 4 helically wound about the exterior surface of the drum shell 2. The strip 4 is formed of a thermally resistant silicon rubber which is heat-resistant to at least 240° C. The elasticity of the silicon rubber strip 4 has a Shore hardness within the range of generally 30–70, but preferably the Shore hardness is generally in the range of about 55–65.

Figure 2:
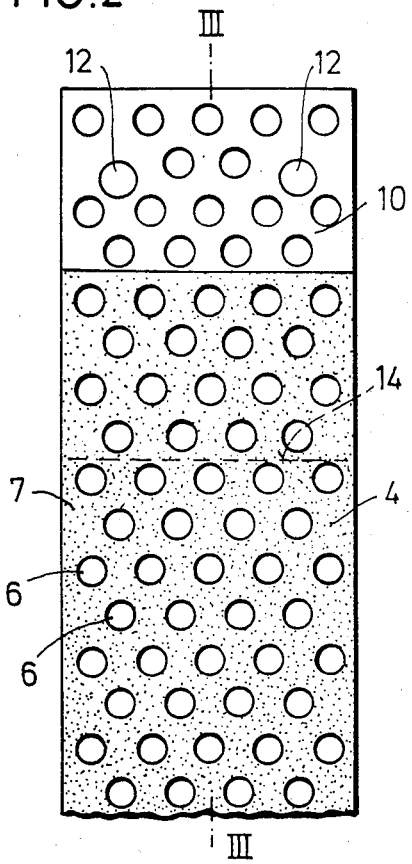
FIG. 2 is a fragmentary plan view of the silicon strip and illustrates a roughened exterior surface and a stepped end defining a tongue thereof.

Cured within the silicon rubber strip 4 is a net-like or mesh-type inlay 5 of glass fibers or stainless steel, brass or like wire material. The silicon rubber strip 4 is also provided with through holes or perforations 6 which are regularly or irregularly distributed thereover, in the manner most readily apparent from FIGS. 2 and 4 of the drawings. On its outer or exterior surface (unnumbered in FIG. 2), the strip 4 is provided with a roughened surface 7 produced mechanically or by chemical etching. The same roughening 7 might be provided by corrugations, such as a number of parallel or crossing grooves of a relatively shallow depth. The roughened surface 7 is provided such that a cloth or textile cover can be applied over the exterior of the strip(s) 4 when the latter is wound over the entire outer peripheral or cylindrical surface of the drum shell 2 in a conventional manner. By so roughening the surface 7, the cloth or textile covering will not shift or slip relative to the surface of the drum shell 2 during an ironing or mangling operation when, of course, the ironing roll 1 is rotated in a conventional fashion.

Figure 4:
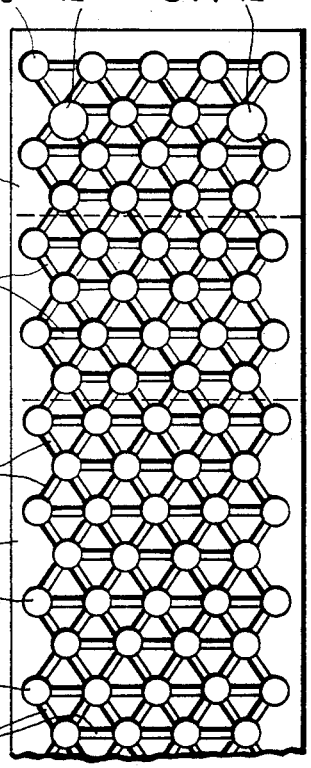
FIG. 4 is a fragmentary plan view of the opposite side of the strip of FIG. 2, and illustrates a plurality of channel-like grooves placing through openings or holes of the strip in fluid communication with each other.

The innermost side (FIG. 4, unnumbered) of the strip 4 which engages the surface of the drum shell 2 is provided with a plurality of shallow channel-like grooves 8 which place the through holes 6 in fluid communication with each other. These grooves 8 thereby ensure the introduction of steam from the interior of the drum shell 2 through the strips 4, the cloth covering thereover, etc. into the textile being ironed and also the escape of steam/vapors from the material being ironed back through the cloth covering through the holes 6, the channels 8, and into the interior of the drum shell 2 which occurs generally by means of an appropriate fan. Condensation formed during an ironing/mangling operation will, thus, not be left in the strip(s) 4 or the padding layer formed thereby. In order to assure the latter fluid communication, each hole 6 should be connected at least once by an associated channel 8 to an adjacent hole 6. The grooves or channels 8 may also extend only axially or only radially, although in the preferred form of the invention, the grooves 8 can extend axially and/or radially, or even obliquely (FIG. 4).

Figure 3:
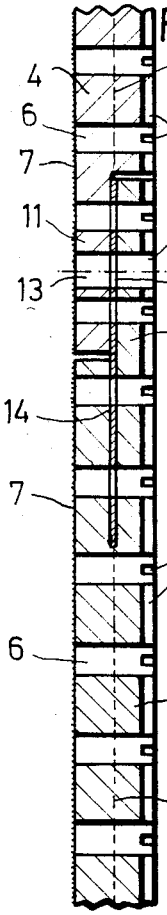
FIG. 3 is a fragmentary sectional view taken generally along line 3—3 of FIG. 2, and illustrates tongues of two strips in overlapped relationship, a perforated metallic sheet therebetween, and a net or mesh inlay of both strips.

The strip 4 can be made of a single length sufficient to be helically wound about the drum shell 2 to cover the same entirely. However, where the drum shell 2 is of a relatively large diameter, it may simply be too cumbersome to form a strip 4 of such a long length. Thus, a number of individual identical strips can be formed and ends (unnumbered) thereof are preferably stepped or offset to forms tongues 10 and 11 of approximately half the total strip thickness such that the same can be overlapped in the manner shown in FIG. 3. These tongues 10 and 11 are also preferably provided with holes 12, 13 which can be aligned with each other (FIG. 3) and through which appropriate securing means (such as screws or rivets) can be passed and engaged to connect the tongues 10, 11 to each other. One end of each strip 4 also has cured therein a sheet 14 having holes 15 (FIG. 3) aligned with the holes 12 of its strip and alignable with the holes 13 at the opposite end of the next adjacent strip. For example, as shown in FIG. 3, the lower strip 4 has the metal strip 14 bonded therein these whereas the downwardly projecting tongue 11 of the uppermost strip 4 is absent a metallic sheet corresponding to the sheet 14. However, the holes 12, 15 of the bottom strip 4 are aligned with each other and are aligned with the holes 13 of the upper strip 4. Bolts, rivets or the like pass through the holes 12, 13, 15 to hold the tongues thereof assembled and, of course, the metallic sheet 14 make certain that the tensile forces do not damage or tear the interconnected tongues 10, 11 of the strips 4, 4.

The sheet 14 may be roughened or provided with barbs projecting from opposite faces so that when the same has been cured in the sandwiched relationship shown in FIG. 3, it will not be torn therefrom under tensile forces.

Subject to the drum size which may be within the range of about 180 mm to amount 1600 mm, the strips 4 may vary in thickness. The strips applied to medium sized drums may be about 8 to 12 mm thick with the holes 6 being about 4 to 10 mm in diameter. The holes in the drum shell 2 are generally substantially larger, e.g., of a diameter from 12 to 15 mm. Due to the plurality of holes in the drum shell 2 and in the strip(s) 4 wrapped thereabout, it is ensured that a sufficient number of these holes (strip and drum) will overlap to permit the free escape of vapor. The width of the strip(s) 4 for medium sized drums varies between 40 to 60 mm with the standard width being advantageously 50 mm. In the case of smaller size drums, the width of the strips 4 with a smooth substratum to be wound on may be smaller, e.g., to about 25 to 30 mm. The width of the channel-type grooves 8 is generally between 1 to 2 mm.

Although in a preferred embodiment of the invention as has been specifically illustrated and described herein, it is to be understood that minor variations may be made in the apparatus without departing from the spirit and scope of the invention, as defined in the appended claims.

What is claimed is:

1. An ironing roller particularly adapted for use in a heated trough mangle comprising a hollow cylindrical drum having a plurality of perforations therethrough thereby forming a generally screen-type perforated shell, a gas permeable padding layer formed of intrinsic elastic material, said padding layer being defined by at least one strip of said material being wrapped helically about said shell, said elastic material being thermally resistant resilient silicon rubber having a Shore hardness generally within the range of 50 to 75, and a mesh-like inlay within said at least one strip.

2. The ironing roller as defined in claim 1 wherein said Shore hardness is preferably generally within the range of 55 to 65.

3. The ironing roller as defined in claim 1 wherein said padding layer includes an exterior cylindrical roughened surface.

4. The ironing roller as defined in claim 1 wherein said strip has a plurality of through holes distributed along the length thereof.

5. The ironing roller as defined in claim 1 wherein said strip has an undersurface engaging said perforated shell, a plurality of through holes distributed along the length of said strip, and grooves in said undersurface interconnecting said through holes.

6. The ironing roller as defined in claim 1 including at least a second strip of material forming said padding layer, said second strip also being formed of thermally resistant resilient silicon rubber having a Shore hardness generally within the range of 50 to 75, a second mesh-like inlay within said second strip, each said one strip and second strip having at least one stepped end and defining a tongue, said tongues being in overlapped relationship to each other, and means for securing said tongues together.

7. The ironing roller as defined in claim 1 wherein said strip is generally 12 mm thick and generally in the range of 40 to 80 mm wide, and said strip has a plurality of through holes of a diameter generally in the range of 4 to 10 mm along the length of said strip.

8. The ironing roller as defined in claim 1 wherein said strip has an undersurface engaging said perforated shell, a plurality of through holes distributed along the length of said strip, grooves in said undersurface interconnecting said through holes, and said grooves are generally in the range of 1 to 2 mm in width.

9. The ironing roller as defined in claim 1 including a fabric cover covering an exterior generally cylindrical surface of said padding layer.

10. The ironing roller as defined in claim 9 wherein said Shore hardness is preferably generally within the range of 55 to 65.

11. The ironing roller as defined in claim 9 wherein said strip has a plurality of through holes distributed along the length thereof.

12. The ironing roller as defined in claim 9 wherein said strip has an undersurface engaging said perforated shell, a plurality of through holes distributed along the length of said strip, and grooves in said undersurface interconnecting said through holes.

13. The ironing roller as defined in claim 9 including at least a second strip of material forming said padding layer, said second strip also being formed of thermally resistant resilient silicon rubber having a Shore hardness generally within the range of 50 to 75, a second mesh-like inlay within said second strip, each said one strip and second strip having at least one stepped end and defining a tongue, said tongues being in overlapped relationship to each other, and means for securing said tongues together.

14. The ironing roller as defined in claim 9 wherein said padding layer includes an exterior cylindrical roughened surface.

15. The ironing roller as defined in claim 14 wherein said strip has a plurality of through holes distributed along the length thereof.

16. The ironing roller as defined in claim 15 wherein said strip has an undersurface engaging said perforated shell, a plurality of through holes distributed along the length of said strip, and grooves in said undersurface interconnecting said through holes.

17. The ironing roller as defined in claim 15 including at least a second strip of material forming said padding layer, said second strip also being formed of thermally resistant resilient silicon rubber having a Shore hardness generally within the range of 50 to 75, a second mesh-like inlay within said second strip, each said one strip and second strip having at least one stepped end and defining a tongue, said tongues being in overlapped relationship to each other, and means for securing said tongues together.

18. The ironing roller as defined in claim 14 wherein said strip has an undersurface engaging said perforated shell, a plurality of through holes distributed along the length of said strip, and grooves in said undersurface interconnecting said through holes.

19. The ironing roller as defined in claim 14 including at least a second strip of material forming said padding layer, said second strip also being formed of thermally resistant resilient silicon rubber having a Shore hardness generally within the range of 50 to 75, a second mesh-like inlay within said second strip, each said one strip and second strip having at least one stepped end and defining a tongue, said tongues being in overlapped relationship to each other, and means for securing said tongues together.

* * * * *

UNITED STATES PATENT AND TRADEMARK OFFICE

CERTIFICATE OF CORRECTION

PATENT NO. : 4,584,747

DATED : April 29, 1986

INVENTOR(S) : Helmut Katterbach et al

It is certified that error appears in the above-identified patent and that said Letters Patent is hereby corrected as shown below:

In the Heading, the inventors' names:

"Helmüt Katterbach, Klaüs Schröter and Johannes Daniel"

should correctly read:

-- Helmut Katterbach, Klaus Schröter and Johannes Daniel --.

Signed and Sealed this

Twenty-first Day of October, 1986

[SEAL]

*Attest:*

DONALD J. QUIGG

*Attesting Officer*

*Commissioner of Patents and Trademarks*